United States Patent [19]

Laxo

[11] Patent Number: 4,607,397

[45] Date of Patent: Aug. 26, 1986

[54] PORTABLE HARD HAT

[75] Inventor: Darryl E. Laxo, Novato, Calif.

[73] Assignee: Chevron Research Company, San Francisco, Calif.

[21] Appl. No.: 655,392

[22] Filed: Sep. 27, 1984

[51] Int. Cl.[4] ..... A42B 1/06

[52] U.S. Cl. ..... 2/410

[58] Field of Search ..... 2/410, 411, 425, 421, 2/6

[56] References Cited

U.S. PATENT DOCUMENTS

| | | | |
|---|---|---|---|
| 3,514,787 | 6/1970 | Kennedy | 2/410 |
| 3,991,422 | 11/1976 | Saotome | 2/410 |
| 4,091,470 | 5/1978 | Ryunoshin | 2/410 |
| 4,131,954 | 1/1979 | Brock et al. . | |
| 4,288,268 | 9/1981 | Hartung | 2/410 X |
| 4,291,417 | 9/1981 | Pagano . | |
| 4,324,005 | 4/1982 | Willis . | |

OTHER PUBLICATIONS

German Publication No. 1,053,195 published 11-1954.

*Primary Examiner*—Henry S. Jaudon
*Assistant Examiner*—J. L. Olds
*Attorney, Agent, or Firm*—P. L. McGarrigle; Edward J. Keeling

[57] ABSTRACT

The present invention relates to a hard hat which may be collapsed and easily stored when not in use. The hat uses a brim as a structural support, multiple curved segments and means for locking the segments into place. The multiple curved segments have raised and lowered portions, decreasing radii, and a common pivot point on the sides of the brim. In the collapsed position all the segments are stacked on one side of the brim, but when the hat is to be extended, the first curved segment is rotated about the common axis. As it is rotated a lowered portion on the back inner surface of the segment engages a raised portion on the front outer face of the next segment and it is drawn (as are the remaining segment) along with the first segment. Once the first segment has reached its position on the further side of the brim, the first segment is then locked into place and the hat is complete.

13 Claims, 5 Drawing Figures

PORTABLE HARD HAT

FIELD OF THE INVENTION

This device relates to headgear that protects the wearer against impact, and, more specifically, to head protection equipment that may be collapsed and stored in an easy manner.

BACKGROUND OF THE INVENTION

On-site visits to construction or manufacturing sites frequently require a visitor to wear a hard hat to protect against occasional impact from falling objects projectiles or low ceilings. As each site does not always have a hat for each visitor to wear, generally one must be brought. However, these hard hats are invariably bulky and difficult to transport because they are of single-piece construction, and since they are bulky, people do not always wish to carry them around. As a result, they are not always available when they are needed.

Furthermore, when single piece construction hard hats are carried in a vehicle to go to a construction site, they are frequently placed on an area such as the back-shelf or the dashboard. When the vehicle is involved in an accident, the hard hat becomes another projectile to injure the driver or any occupants within the car.

There have been patents disclosing portable or collapsible protective gear for the head such as Ryunoshin et al, U.S. Pat. No. 4,091,470; Pagano, U.S. Pat. No. 4,291,417; Brock et al, U.S. Pat. No. 4,131,954; and Willis, U.S. Pat. No. 4,324,005. However, devices such as in Brock et al and Pagano are adapted for use in protecting the wearer against rainy weather. For example, Brock et al shows collapsible headgear having ribs extending radially from a center hub that support a flexible covering much like an umbrella. Pagano is employed for the same purpose and has thin ribs that support a flexible transparent material. The ribs are attached to a hub on each side of the wearer's collar and enclose the wearer's entire head down to the point below the chin. Willis discloses an inflatable protective headgear for use in emergency impact situations. Ryunoshin et al disclose a collapsible protective helmet having rigid fan-like members extending radially from one central hub on the top of the helmet.

Due to the fact that people are less likely to carry around a single piece construction hard hat, and if they did, it might become a projectile in a vehicular accident, it is an object of this invention to construct a hard hat that is collapsible, easily stored, and as a result, readily available for use when needed. It is also an object of this invention to provide a collapsible hard hat while still providing a helmet that will protect the wearer's head against impact.

SUMMARY OF THE INVENTION

Broadly speaking, the present invention is a collapsible hard hat for protecting the head of the wearer in the event of an impact. It includes, typically a substantially circular base ring having a brim which provides support for multiple curved members. Each member pivots about a common axis that runs between two hubs, one on either side of the base ring. The segments have raised and lowered edges so that when the first segment is rotated about the common axis, the other segments will likewise follow and interlock in a type of "S" joint.

Once all segments are in place, a mechanism, located on the base segment, locks them into position.

DETAILED DESCRIPTION OF THE INVENTION

Figure 1:
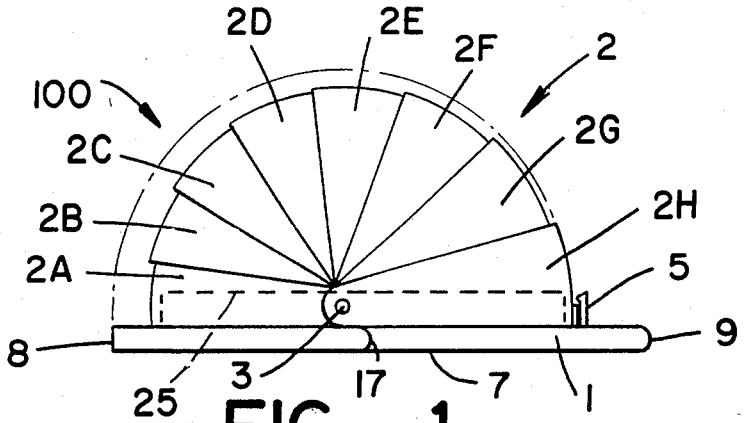
FIG. 1 is a side view of the hard hat showing a plurality of interlocking segments extended to form the hat.
Figure 2:
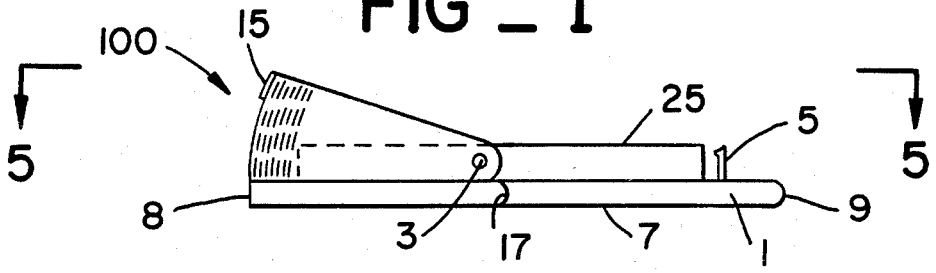
FIG. 2 is a side view of the hard hat in FIG. 1 showing the interlocking segments collapsed.
Figure 3:
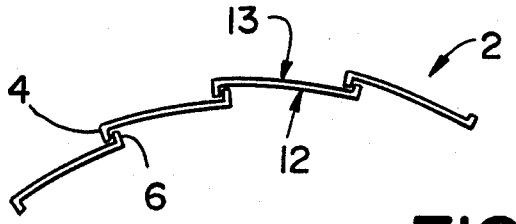
FIG. 3 is a cross-sectional view of the interlocking system of the segments in FIGS. 1 and 2.

Referring now to FIGS. 1 and 2, a portable hard hat 100 is shown in both the collapsed (FIG. 2) and extended (FIG. 1) positions. As shown in FIGS. 1, 2, and 5, the hat 100 typically consists of a generally planar base ring 1 (or brim) that has a front 9, back 8, two sides 7 (7A and 7B in FIG. 5), and aperture 20. Mounted in the brim is a cover 2 in the form of multiple semi-circular curved segments 2A–2H that are attached to each side at pivots 3A and 3B and are arranged to rotate about a common axis 14 (shown in FIG. 4). They are all essentially the same with the exception of the first segment 2H which has an additional raised portion or hitch 15 on its surface (FIG. 2). The base ring 1 also has a clasp 5 and may also be fitted with an article for keeping the hard hat 100 affixed to the wearer, i.e., such as a chin strap or back strap (not shown). A hat liner 25 may also be added to protect the head of the wearer by separating the shell from the head and cushioning and absorbing some of the impact energy of a falling object.

Figure 4:
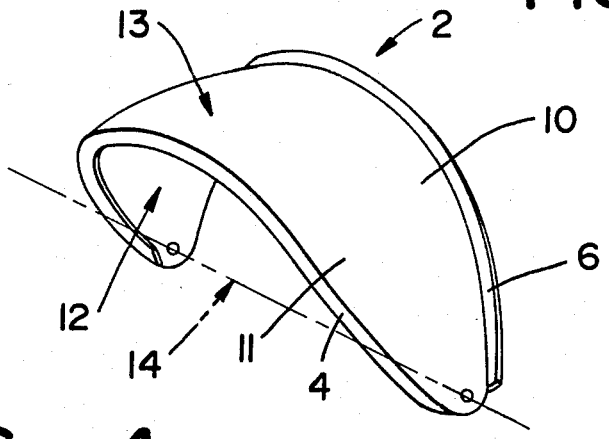
FIG. 4 is a view of an isolated interlocking segment.
Figure 5:
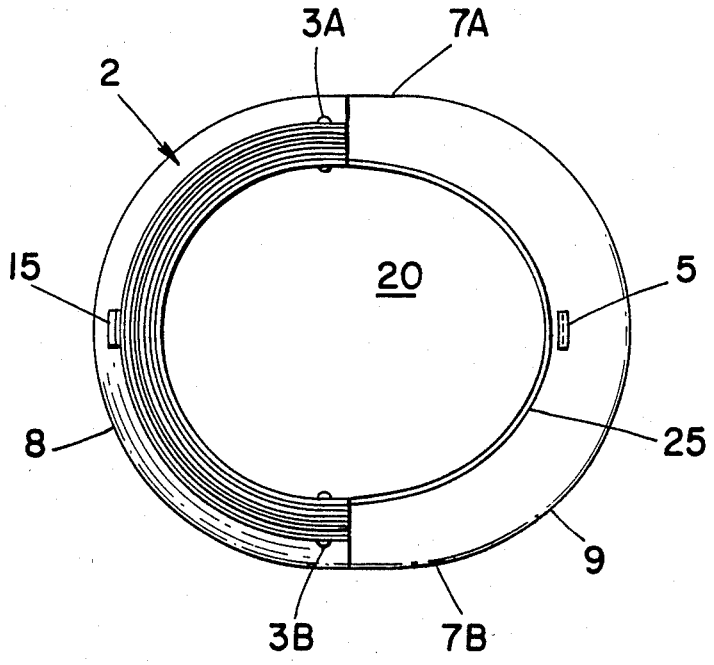
FIG. 5 is a plan view of the hat in FIG. 2 as seen from above.

As shown in FIG. 4, each substantially semi-circular curved segment 2 has an inner surface 12 and an outer surface 13 with a front edge 10 and a back edge 11. Raised portion 6 is shown on the outer surface 13 at the front 10 edge and a lowered portion 4 is shown on the inner surface 12 at the back edge 11. (The edges 10 and 11 could conceivably be reversed and serve the same purpose.) The first segment 2H which has a larger radius than all other members and is located exterior to the other members. Each of the other curved segments 2G–A has a gradually decreasing radius to allow them to fold (or stack) one inside one another.

The hard hat 100, in the collapsed position as shown in FIG. 2, may be stored in a briefcase or underneath a car seat. In this fashion, it may be readily transported. However, once the bearer wishes to use the hat 100, a simple procedure is all that is necessary to reshape or extend it. All the wearer has to do is to grasp the first segment 2H and rotate it about a pivot 3 (3A and 3B in FIG. 5) which are on the common axis 14. As the first segment rotates, a lowered portion 4 grasps a raised portion 6 at the outer side 13 of the front edge 10 of the next segment. (As mentioned earlier, a similar result could be obtained if the edges were reversed. For example, a lowered portion 6 at the back edge 11 of the outer surface 13 could come into communication with a raised portion 6 at the front edge 10 of the inner surface 12.) This causes the next segment to follow the path of the first segment as they are now hooked together in an "S" joint. The same connection happens to the remaining segments for as far as the rotation continues so that a complete protective shield extends from the back 8 of base ring 1 to the front 9. At this point, the clasp 5 and hitch 15 are used to fasten the first segment 2H to the base ring 1 so that the segments will be fixed and will not move. The latching device is envisioned as a two-piece mechanism requiring no moving parts. Hitch 15 consists of a front facing protrusion extending from the first rotating segment 2H, which incorporates a surface to mate with clasp 5. The clasp 5 consists of a cantilevered leaf spring extending from the base 1. The clasp 5 is located at a distance from the inner edge of the base 1 (see FIGS. 1 and 2) which allows segment 2H to seat on the base ring 1. Clasp 5 has a rear facing extension at its outer end, which matches the protrusion from the hitch 15 on segment 2H. The upper surface of the clasp 5 is angled to allow segment 2H to slide down and push the clasp 5 away during assembly of the hat 100. The spring stiffness of the clasp 5 will cause the hitch 15 to slide over the protrusion upon seating. This captures segment 2H and affixes it to the base ring 1 and retains the hat 100 in the assembled state. Collapse of the hat 100 merely requires pressing the clasp 5 forward with the thumb or finger on the angled extension surface until the hitch 15 clears the clasp 5. Continued rotation of the segments collapses the hat 100 for storage. This clasp 5 and hitch 15 allows assembly or collapse of the hat 100 entirely by feel, with no visibility required, and may be done with heavy work gloves on the hands.

In the event that an object does fall on the top of the hard hat 100, the force will be distributed over the length of the segment 2. The overlapping "S" type joints will ensure that an object does not intrude into a gap in the helmet 100 and a proper material may be used so that impact will not cause a hole to be punctured in any segment 2A–2H. Examples of proper helmet material would include plastic, fiber reinforced epoxy or other electrically non-conductive materials.

Once the bearer has no further use for the hat 100, the first segment 2H may be unfastened from the clasp 5 and hitch 15 and rotated towards the back 8 of base ring 1. At first, segment 2H is rotated so that all other members are unlocked and are now free to be moved back to collapsed position. They are then rotated to the stacked storage position shown in FIG. 2. To further collapse the hard hat 100, a pivot 17 could be designed into the base ring 1 so that the hat 100 may be folded into one-half of the size of the base ring 1. In any event, once collapsed, the hat may be put away.

Although a certain specific embodiment of the invention has been described here in detail, the invention is not to be limited to such embodiment, but rather only by the appended claims.

What is claimed is:

1. A portable and collapsible hard hat for protecting the wearer against impacts, which comprises:

a base ring member having a front, back, two sides, and a curvilinear aperture located therein;

a plurality of substantially semi-circular curved segments attached to said base ring member having a first segment and a common axis for all segments;

a common pivot so that each segment can rotate about said common axis, said pivot being located on each side of said base ring member;

means for interlocking each segment; and means for locking the segments to the base ring member, comprising, a hitch located on said first segment having a front facing protrusion;

a clasp located away from said curvilinear aperture on said base ring member in an upwardly extending manner, said clasp being a cantilevered leaf spring which has a rear-facing extension at its outer end which matches the protrusion on said hitch;

so that when the first curved segment is pivoted about said axis, the other segments will likewise follow until contact and connection with the base ring member is made.

2. A portable and collapsible hard hat as recited in claim 1 wherein the means for interlocking the segments are raised edges on each of said segments.

3. A portable hard hat as recited in claim 1 where each segment has a decreasing radius beginning with said first segment.

4. A portable hard hat as recited in claim 1 where the hat material is hard enough to protect the wearer from impact.

5. The portable hard hat as recited in claim 4 where the material forming the hat is fiber reinforced epoxy.

6. The portable hard hat as recited in claim 4 where the material forming the hat is a plastic.

7. The portable hard hat as recited in claim 4 where the material forming the hat is electrically nonconductive.

8. The portable hard hat as recited in claim 1 where said base ring member is also collapsible about said common axis.

9. The portable hard hat as recited in claim 1 where said base ring member is rigid and made of one piece.

10. The portable hard hat as recited in claim 1 where said base ring member serves as a mounting place for a hat liner so that the hat may be adjusted to fit the wearer, the liner also protecting the wearer by separating the shell from the head and cushioning and absorbing some of the impact energy of the falling object.

11. The portable hard hat as recited in claim 10 whereby the liner is flexible enough to collapse within the base ring member and not hinder the portability of the hat.

12. A portable and collapsible hard hat that is adapted to protect the wearer from impact blows and still be conveniently transported which comprises;

a rigid, one-piece base ring having a substantially circular aperture therein where said base ring has a front, a back and two sides, a plurality of substantially semi-circular rigid curved segments of decreasing radius attached to said base ring having an inner face, an outer face, and a front and a back side, said plurality having a first segment, a common pivot located on each side of said base ring around which said curved segments may rotate about a common axis, raised edges located on said front outer faces and lowered edges located on said back inner faces of each of said curved members, catch means for locking said base ring to said first curved segment, comprising, a hitch located on said first segment having a front facing protrusion, and a clasp located away from said circular aperture on said base ring in an upwardly extending manner, said clasp being a cantilevered leaf spring which has a rear-facing extension at its outer end which matches the protrusion on said hitch, so that when said first segment is rotated about said common axis, each segment will, in turn, be drawn about said common curved axis by contact with each of the raised edges until said first segment makes contact and latches to said base ring.

13. A collapsible hard hat to protect the wearer against impacts, that comprises:

a plurality of curved segments which collapse in a nested configuration and expand to an expanded configuration to form a protective cover of the hard hat, said plurality having a first segment;

a brim having pivots at each side of its central opening, which pivots receive respective ends of the curved segments and form a common axis of the segments as they pivot from the nested configuration to the expanded configuration and vice versa;

said curved segments having interacting means by which each segment, when expanding from the nested configuration to the expanded configuration, grasps the next successive segment so that the segments pivot successively about said common axis to form said protective cover; and latch means to secure the segments to the brim in the expanded configuration, said latch means comprising, an upwardly extending clasp located on the front of said brim away from said central opening, said clasp being a cantilevered leaf spring which has an angled rear-facing extension, and a hitch located on said first segment that is pivoted to contact said brim in the area of the clasp, said hitch having a front facing protrusion which, when rotated down past, and engaged with, the tapered, rear-facing extension of said clasp, locks the first segment to the brim.

* * * * *